US008075288B2

(12) United States Patent
Schofield

(10) Patent No.: US 8,075,288 B2
(45) Date of Patent: Dec. 13, 2011

(54) SCREW PUMP AND PUMPING ARRANGEMENT

(75) Inventor: Nigel Paul Schofield, Horsham (GB)

(73) Assignee: Edwards Limited, Crawley, West Sussex (GB)

( * ) Notice: Subject to any disclaimer, the term of this patent is extended or adjusted under 35 U.S.C. 154(b) by 182 days.

(21) Appl. No.: 10/586,267

(22) PCT Filed: Jan. 14, 2005

(86) PCT No.: PCT/GB2005/000126

§ 371 (c)(1),
(2), (4) Date: Jul. 14, 2006

(87) PCT Pub. No.: WO2005/071268

PCT Pub. Date: Aug. 4, 2005

(65) Prior Publication Data

US 2008/0226481 A1 Sep. 18, 2008

(30) Foreign Application Priority Data

Jan. 23, 2004 (GB) ..... 0401484.1

(51) Int. Cl.
*F03C 2/00* (2006.01)
*F03C 4/00* (2006.01)
*F04C 2/00* (2006.01)

(52) U.S. Cl. ..... 418/15; 418/9; 418/201.1

(58) Field of Classification Search ..... 418/5, 9, 418/10, 15, 201.1, 206.1, 206.4
See application file for complete search history.

(56) References Cited

U.S. PATENT DOCUMENTS

| | | | | |
|---|---|---|---|---|
| 2,580,006 | A * | 12/1951 | Densham | 418/15 |
| 3,420,180 | A * | 1/1969 | Schmitt et al. | 418/15 |
| 3,677,664 | A * | 7/1972 | Wycliffe et al. | 418/9 |
| 4,068,984 | A * | 1/1978 | Spindler | 418/9 |
| 4,631,009 | A * | 12/1986 | Cygnor et al. | 418/15 |
| 5,352,097 | A * | 10/1994 | Itou et al. | 417/42 |
| 5,611,863 | A | 3/1997 | Miyagi | |
| 6,196,810 | B1 * | 3/2001 | Taniguchi et al. | 417/248 |
| 6,705,847 | B1 * | 3/2004 | Sagawe et al. | 418/15 |
| 7,395,948 | B2 * | 7/2008 | Kogan | 222/136 |

FOREIGN PATENT DOCUMENTS

| | | | |
|---|---|---|---|
| DE | 198 20 622 | A1 | 11/1999 |
| GB | 637942 | | 5/1950 |
| GB | 2 030 227 | A | 4/1980 |
| GB | 2 299 832 | A | 10/1996 |
| WO | WO 0116489 | A2 * | 3/2001 |
| WO | WO 2004/007797 | A1 | 1/2004 |

OTHER PUBLICATIONS

United Kingdom Search Report of Application No. GB 0401484.1; Date of search: May 18, 2004.
PCT Notification of Transmittal of the International Search Report and the Written Opinion of the International Searching Authority, or The Declaration of International Application No. PCT/GB2005/000126; Date of mailing: Apr. 13, 2005.

(Continued)

*Primary Examiner* — Theresa Trieu

(57) ABSTRACT

A screw pump and pumping arrangement including a screw pump having a chamber and externally threaded rotors mounted on shafts for counter-rotation and flow paths with fluid inlets located at a common low pressure side of the chamber.

19 Claims, 2 Drawing Sheets

OTHER PUBLICATIONS

PCT International Search Report of International Application No. PCT/GB2005/000126; Date of mailing of the International Search Report: Apr. 13, 2005.

PCT Written Opinion of the International Searching Authority of International Application No. PCT/GB2005/000126; Date of mailing: Apr. 13, 2005.

* cited by examiner

SCREW PUMP AND PUMPING ARRANGEMENT

FIELD OF THE INVENTION

The invention relates to a screw pump.

BACKGROUND OF THE INVENTION

A screw pump comprising two externally threaded rotors mounted in a pump body and adapted for counter-rotation in the body with intermeshing of the rotor threads is well known. Close tolerances between the rotor threads at the points of intermeshing and with the internal surfaces of the pump body cause volumes of gas being pumped between an inlet and an outlet to be trapped between the threads of the rotors and the internal surface of the pump body and thereby urged through the pump as the rotors rotate.

Such screw pumps are potentially attractive because they can be manufactured with few working components and they have an ability to pump from a high vacuum environment at the pump inlet down to atmospheric pressure at the pump outlet. As a result, a screw pump may be employed as a backing pump for a secondary pump, such as a turbomolecular pump, for evacuating a process tool.

If a screw pump has a sufficiently high capacity, two turbomolecular pumps could be simultaneously backed by a single screw pump by connecting the exhausts of the turbomolecular pumps to the inlet of the screw pump via a common backing line. However, in such an arrangement, any variation in the flow rate of pumped gas exhaust from one of the turbomolecular pumps could change the fluid pressure within the common backing line, which in turn would affect the performance of the other turbomolecular pump exhausting into the common backing line. In view of this, typically each secondary pump is backed by a respective pump.

It is an aim of at least the preferred embodiment of the present invention to provide an improved screw pump which can simultaneously back two pumps whilst substantially avoiding the aforementioned problem.

SUMMARY OF THE INVENTION

In a first aspect, the present invention provides a screw pump comprising a chamber defining with first and second externally threaded rotors mounted on respective shafts and adapted for counter-rotation within the chamber a plurality of flow paths having respective fluid inlets.

By providing two inlets for the chamber, separate flow paths can be defined within the chamber, the flow paths being isolated from each other by the screw pump mechanism until the paths merge at, for example, the pump outlet. By isolating the fluid passing along one flow path from the fluid passing along the other, pressure differentials between the first and second flow paths can be substantially maintained, and so any fluctuation in the pumping rate of one pump connected to the screw pump does not significantly affect the performance of the other pump connected to the screw pump. Thus, a single screw pump can be provided for backing simultaneously two secondary pumps, reducing the cost and size of the footprint of a pumping arrangement for two process tools.

In a preferred embodiment, the inlets are located towards or at a low pressure side of the chamber, and a fluid outlet is located towards or at a high pressure side of the chamber. For example, the inlets may be formed in a common surface defining the chamber, and may be located on a common plane, for example, substantially perpendicular to rotational axes of the shafts. The pump may comprise a pump body defining said chamber, the body having first and second opposing plates, and wherein the fluid inlets are formed in the first plate and a fluid outlet is formed in the second plate. Alternatively, or in addition, an inlet can be provided in a side wall of the chamber, thereby providing inter-stage porting.

Preferably, a first flow path is defined between the internal surface of the chamber and the external surface of the first rotor, and a second flow path is defined between the internal surface of the chamber and the external surface of the second rotor. The flow paths are preferably arranged such that fluid flows along the flow paths in substantially the same direction.

In a second aspect, the invention provides a pumping arrangement comprising a screw pump as aforementioned, a first pumping unit having an exhaust connected to a first inlet of the screw pump and a second pumping unit having an exhaust connected to a second inlet of the screw pump.

In a third aspect, the present invention provides a pumping arrangement comprising a screw pump, the screw pump comprising a body defining a chamber housing first and second externally threaded rotors mounted on respective shafts and adapted for counter-rotation within the chamber, the rotors defining with the body first and second flow paths passing through the chamber, each flow path having a respective fluid inlet located in said body, a first pumping unit having an exhaust connected to the fluid inlet of the first flow path of the screw pump, and a second pumping unit having an exhaust connected to the fluid inlet of the second flow path of the screw pump.

Preferred features of the present invention will now be described, by way of example only, with reference to the accompanying drawings, in which:

DETAILED DESCRIPTION OF THE INVENTION

Figure 1:
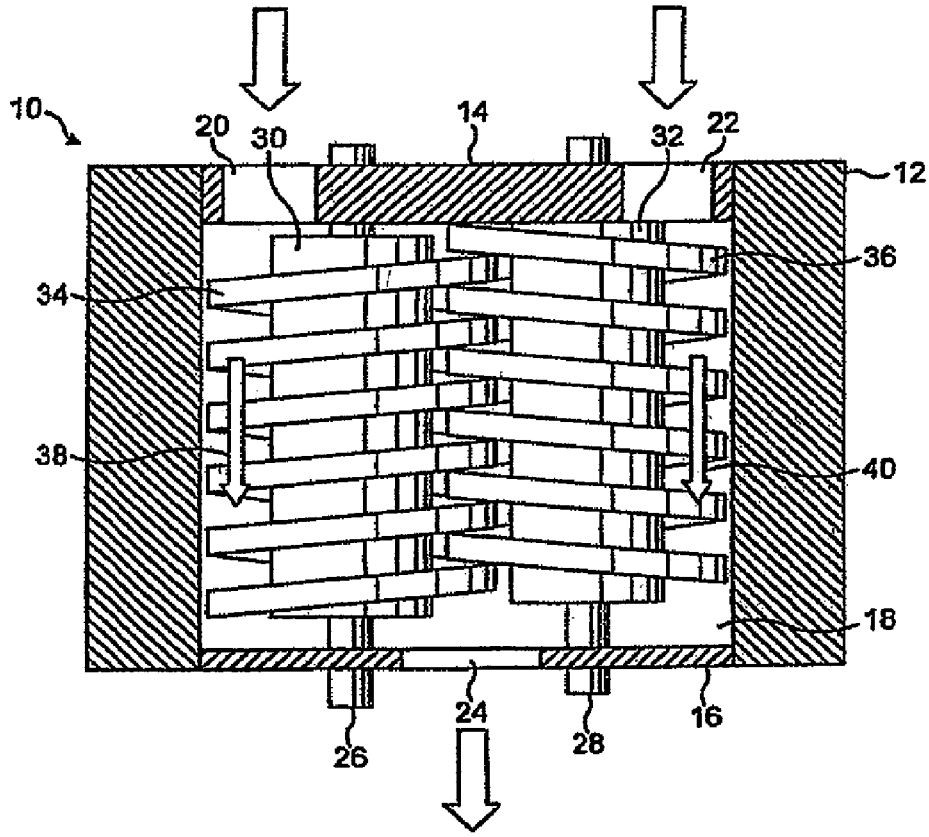
FIG. 1 illustrates a cross-section of an embodiment of a screw pump according to the invention.

The pump 10 includes a pump body 12 having a top plate 14 and a bottom plate 16 defining a chamber 18 therebetween. First and second fluid inlets 20, 22 to the chamber 18 are formed in the top plate 14, and a fluid outlet 24 from the chamber 18 is formed in the bottom plate 16.

The pump 10 further includes a first shaft 26 and, spaced therefrom and parallel thereto, a second shaft 28 having longitudinal axes substantially orthogonal to the top plate 14 and bottom plate 16. Bearings (not shown) are provided for supporting the shafts 26, 28. The shafts 26, 28 are adapted for rotation within the chamber 18 about the longitudinal axes in a contra-rotational direction. One of the shafts 26, 28 is connected to a drive motor (not shown), the shafts being coupled together by means of timing gears (not shown) so that in use the shafts 26, 28 rotate at the same speed but in opposite directions.

A first rotor 30 is mounted on the first shaft 26 for rotary movement within the chamber 18, and a second rotor 32 is similarly mounted on the second shaft 28. Each of the two rotors 30, 32 are of generally cylindrical shape and has a helical vane or thread 34, 36 respectively formed on the outer surface thereof, the threads intermeshing as illustrated. The shape of the rotors 30, 32 and in particular the shapes of the threads 34, 36 relative to each other and to the inner surface of the pump body 12 are calculated to ensure close tolerances with the inner surface of the pump body 12.

In use, the exhaust of a first secondary pump, such as a turbomolecular pump, is connected to a first inlet 20, and the exhaust of a second secondary pump is connected to the second inlet 22. Rotation of the pump shafts 26, 28 pumps fluid entering the pump 10 via the first inlet 20 to pass along a first flow path 38 defined between the internal surface of the pump body 12 and the thread 34 of rotor 30, and pumps fluid entering the pump 10 via the second inlet 22 to pass along a second flow path 40 defined between the internal surface of the pump body 12 and the thread 36 of rotor 32, the flow paths 38, 40 merging at the outlet 24 where the pumped fluid is exhaust from the pump 10 at or around atmospheric pressure.

Figure 2:
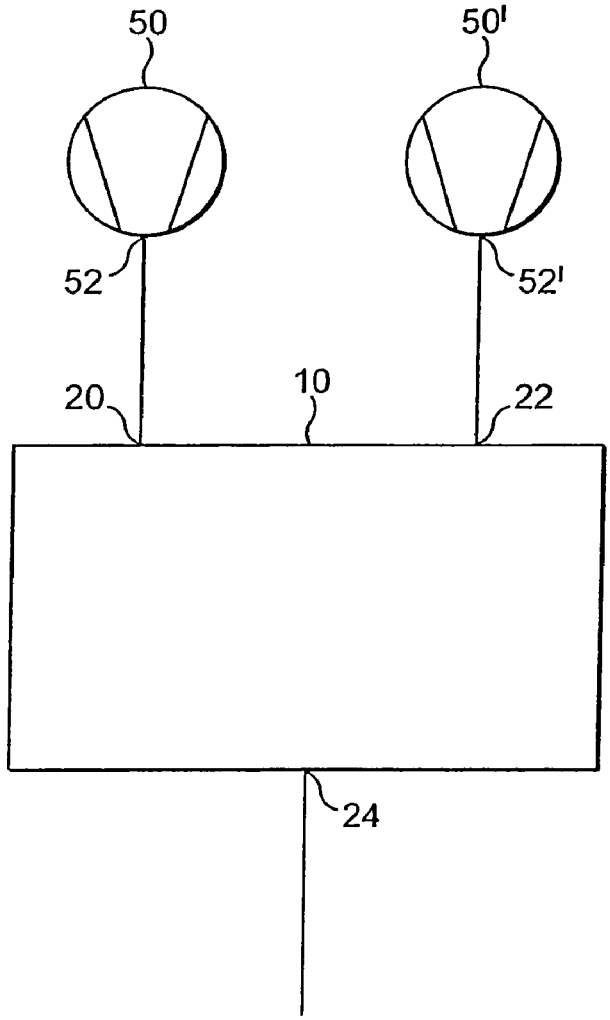
FIG. 2 illustrates a pumping arrangement including the screw pump of FIG. 1.

By defining two flow paths 38, 40 isolated from each other by the rotors 30, 32 until the paths merge at the pump outlet 24, pressure differentials between the flow paths 38, 40 can be substantially maintained, and so any fluctuation in the pumping rate of one of the secondary pumps does not significantly affect the performance of the other secondary pump. Thus, as shown in FIG. 2, a single screw pump 10 can be provided for backing simultaneously two secondary pumps 50, 50', each having an exhaust 52, 52' connected to a respective inlet 20, 22 of the screw pump, thereby reducing the cost and size of the footprint of the pumping arrangement for two process tools.

In summary, the invention provides a dual inlet screw pump, in which a chamber defines with first and second externally threaded rotors respective fluid flow paths within the chamber. This can enable fluid entering the pump via the first inlet to be pumped substantially in isolation from fluid entering the pump via the second inlet.

While the foregoing description and drawings represent the preferred embodiments of the present invention, it will be apparent to those skilled in the art that various changes and modifications may be made therein without departing from the true spirit and scope of the present invention.

I claim:

1. A screw pump comprising:

a chamber defining with first and second externally threaded rotors mounted on respective shafts rotatably disposed for counter-rotation within the chamber a plurality of flow paths having respective fluid inlets wherein a first one and a second one of the respective inlets are located at a common low pressure side of the chamber and on a common plane, and wherein threads of the first and second rotors are intermeshed at a location adjacent to the first and second inlets, such that fluid entering the chamber via the first and second inlets is moved through the flow paths by the first and second rotors in a manner of positive displacement, wherein the flow paths are isolated from each other such that pressure differentials are maintained among the flow paths when the screw pump is in operation.

2. The screw pump according to claim 1 wherein a fluid outlet is located towards or at a common high pressure side of the chamber.

3. The screw pump according to claim 2 comprising a pump body defining said chamber, said body having first and second opposing plates, and wherein the first and second ones of the inlets are formed in the first plate and the fluid outlet is formed in the second plate.

4. The screw pump according to claim 1 wherein the first one and the second one of the respective inlets are formed in a common surface defining the chamber.

5. The screw pump according to claim 1 wherein a first one and second one of the plurality of the flow paths merge at the fluid outlet of the chamber.

6. The screw pump according to claim 1 wherein a first one and a second one of the plurality of the flow paths are arranged such that fluid flows along the flow paths in substantially the same direction.

7. The screw pump according to claim 1 wherein a first one of the plurality of flow paths is defined between an internal surface of the chamber and an external surface of the first rotor, and a second one of the plurality of flow paths is defined between the internal surface of the chamber and an external surface of the second rotor.

8. The screw pump according to claim 1 wherein a first one of the plurality of inlets is at a pressure higher than a pressure at a second one of the plurality of inlets during pumping.

9. A pumping arrangement comprising a screw pump according to claim 1, a first pumping unit having an exhaust connected to the first inlet of the screw pump, and a second pumping unit having an exhaust connected to the second inlet of the screw pump.

10. A pumping arrangement comprising:

a screw pump comprising a body defining a chamber housing first and second externally threaded rotors mounted on respective shafts rotatably disposed for counter-rotation within the chamber, the rotors defining with the body first and second flow paths passing through the chamber, each flow path having a respective fluid inlet located in said body;

a first pumping unit having an exhaust connected to the fluid inlet of the first flow path of the screw pump;

a second pumping unit having an exhaust connected to the fluid inlet of the second flow path of the screw pump; and wherein the fluid inlet of the first flow path and the fluid inlet of the second flow path are located at a common low pressure side of the chamber and on a common plane, wherein the first and second flow paths are isolated from each other such that pressure differentials are maintained between the first and second flow paths when the screw pump is in operation.

11. The pumping arrangement according to claim 10 wherein a fluid outlet is located at a common high pressure side of the chamber.

12. The pumping arrangement according to claim 11 wherein each one of the respective flow paths merge at the fluid outlet of the chamber.

13. The pumping arrangement according to claim 11 wherein the fluid inlet of the first flow path and the fluid inlet of the second flow path are formed in a common surface of the body.

14. The pumping arrangement according to claim 11 wherein each of the plurality of inlets are located on a common plane.

15. The pumping arrangement according to claim 10 wherein each one of the respective inlets are formed in a common surface of the body.

16. The pumping arrangement according to claim 15 wherein each of the plurality of inlets are located on a common plane.

17. The pumping arrangement according to claim 10 wherein each one of the respective flow paths are arranged such that fluid flows along the flow paths in substantially the same direction.

18. The pumping arrangement according to claim 10 wherein a first one of the plurality of flow paths is defined between the body and an external surface of the first rotor, and a second one of the plurality of flow paths is defined between the body and an external surface of the second rotor.

19. The pumping arrangement according to claim 10 wherein a first one of the plurality of inlets is at a pressure higher than a pressure at a second one of the plurality of inlets during pumping.

* * * * *